US005129240A

United States Patent [19]

Schindler

[11] Patent Number: 5,129,240

[45] Date of Patent: Jul. 14, 1992

[54] CIRCULAR KNITTING MACHINE, AND METHOD OF PROVIDING UNIFORM TEMPERATURE CONDITIONS THEREON

[75] Inventor: Hartmut Schindler, Albstadt, Fed. Rep. of Germany

[73] Assignee: SIPRA Patententwicklungs-u.Beteiligungsgesellschaft mbH, Albstadt, Fed. Rep. of Germany

[21] Appl. No.: 611,291

[22] Filed: Nov. 8, 1990

[30] Foreign Application Priority Data

Nov. 22, 1989 [DE] Fed. Rep. of Germany ..... 3938685

[51] Int. Cl.[5] ..... D04B 35/30

[52] U.S. Cl. ..... 66/8

[58] Field of Search ..... 66/8, 115; 112/256; 165/104.22

[56] References Cited

U.S. PATENT DOCUMENTS 3,802,223 4/1974 Wright et al. ..... 66/8
4,719,768 1/1988 Lonati ..... 66/8

FOREIGN PATENT DOCUMENTS 0185265 6/1986 European Pat. Off. .
857669 12/1952 Fed. Rep. of Germany ..... 66/8
2600335 7/1976 Fed. Rep. of Germany ..... 66/8
1305406 4/1987 U.S.S.R. ..... 66/8
797677 7/1958 United Kingdom .
868428 5/1961 United Kingdom ..... 66/8
1143919 2/1969 United Kingdom .
2091302 7/1982 United Kingdom ..... 66/8

*Primary Examiner*—Werner H. Schroeder
*Assistant Examiner*—John J. Calvert
*Attorney, Agent, or Firm*—Michael J. Striker

[57] ABSTRACT

The invention relates to a circular knitting machine comprising a carrier for knitting implements, a cam arrangement and a heat exchange apparatus, and a provision of uniform temperature conditions on a circular knitting machine of that kind. The heat exchange apparatus comprises two circuits of which one is associated with the carrier and the other with the cam arrangement and which have a liquid heat exchange agent, preferably water, flowing through them. The uniform temperature conditions are achieved by the heat exchange output of at least one circuit being so controlled that substantially the same temperature difference obtains between the carrier and the cam arrangement in all operating conditions of the circular knitting machines.

21 Claims, 9 Drawing Sheets

CIRCULAR KNITTING MACHINE, AND METHOD OF PROVIDING UNIFORM TEMPERATURE CONDITIONS THEREON

BACKGROUND OF THE INVENTION

The invention relates to a circular knitting machine comprising at least one carrier in which knitting implements are displaceably mounted, a cam arrangement for controlling the knitting implements and a heat exchange apparatus for the carrier and the cam arrangement. The invention also relates to a method of providing uniform temperature conditions on a circulat knitting machine of the above mentioned type.

In circular knitting machines with large numbers of systems and high speeds of rotation, in particular large-scale circular knitting machines with diameters of 30 inches and with a high output, very high temperatures of up to about 150° Celsius may occur due to the friction between the knitting implements (needles, pressers, sinkers or the like) in the grooves of the carriers (needle cylinder, rib plates, sinker ring or the like) or between the knitting implements and the cam arrangements (cylinder cams, rib cams, sinker cams or the like). A consequence of that is that those components can no longer be touched and any necessary repairs, for example the replacement of a broken needle, can only be carried out when special safety precautions are taken or after the circular knitting machine has adequately cooled down.

Apart from that, circular knitting machines which run hot are frequently found to suffer from operational disturbances, for example pattern errors or variations in the stitch length or the yarn tension, which do not occur when the machines are cold or operating only slowly, even if the circular knitting machine were set in the optimum fashion at ambient temperature. Those operational distrubances must therefore be attributed to the influences of temperature and the fact that varying operating temperatures have a detrimental influence on the operational reliability of a circular knitting machine.

Attempts have already been made to counteract operational disturbances of that kind by means of structural variations in certain parts of the machine, for example the needle cylinder (see German laid-open application (DE-OS) No. 33 16 382). Hitherto however there is no known manner of procedure which could be used to deal with all operational distrubances which must be attributed to temperature influences.

Accordingly generally the use of heat exchange apparatuses is considered as the only possible way of effectively providing remedies in this respect. The heat exchange apparatuses may include for example blowing nozzles by means of which gaseous heat exchange agents, in particular air, are blown from the outside or the inside on to the carriers of the knitting implements and/or the cam arrangements (German utility model No. 76 38 042 and German laid-open applications (DE-OS) Nos. 16 35 836 and 31 01 154) or cooling circuits which are formed in the carriers and through which a liquid coolant, in particular oil, is passed (German patent specification No. 1 635 931 and German laid-open application (DE-OS) No. 22 00 154). It is also known that oil lubricating systems and fuzz blow-off device which are provided on circular knitting machines for other reasons inevitably also have a certain cooling effect. Finally it is known that, in the event of a cold start, circular knitting machines have a tendency to malfunction and it is therefore desirable for them firstly to be allowed to warm up at a low speed before being switched over to their nominal speed of rotation.

The previously known heat exchange apparatuses of that kind are all based on the assumption that more or less uncontrolled temperature adjustment (cooling or heating) of the parts of a circular knitting machine which heat up the fastest and to the greatest extent, for example the needle cylinder, is already sufficient in order to solve all problems which occur in that context. However that assumption has proven to be false in practice. On the contrary, the use of the known heat exchange apparatuses can even result in greater operational disturbances than when such apparatuses are not employed.

SUMMARY OF THE INVENTION

It is therefore an object of the present invention to provide a circular knitting machine designed so that the operational disturbances thereof which are to be attributed to the influences of temperature occur to a much lesser extent than hitherto. The invention also seeks to provide that the operating temperature can be set to such a low value that operations can be carried out on the circular knitting machine even after it has been in operation for a prolonged period of time, without having to attend to particular safety measures and without a prolonged stoppage time.

To solve that problem, the circular knitting machine of the kind set forth in the opening part of this specification is characterised in that the heat exchange apparatus has at least two circuits for a liquid heat exchange agent, wherein the one circuit is associated with the carrier and the other circuit is associated with the cam arrangement. The method according to the invention is characterised in that the carrier and the cam arrangement are adjusted in respect of temperature in a controlled manner with the circuits individually associated with them and with liquid heat exchange agents flowing through the circuits, and the heat exchange output of at least one circuit is so controlled that substantially the same temperature difference is set between the carrier and the cam arrangement under all operating conditions of the circular knitting machine.

The invention is based on the surprising realisation that most of the operational disturbances which are of interest here can be avoided by the temperature difference between the carrier (for example the needle cylinder) and the cam arrangement (for example the cylinder cam) being kept substantially within a preselected tolerance range, under all operating conditions. Therefore the essential consideration for disturbance-free operation of a circular knitting machine is not the presence of some heat exchange apparatus but the separate and controlled temperature adjustment of the carrier and the cam arrangement. The circular knitting machine according to the invention therefore provides the necessary requirements for meaningful temperature control, while the method according to the invention specifies how uniform temperature conditions can be achieved with such a circular knitting machine under all operating conditions and how operational disturbances caused by the influences of temperature can be extensively avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
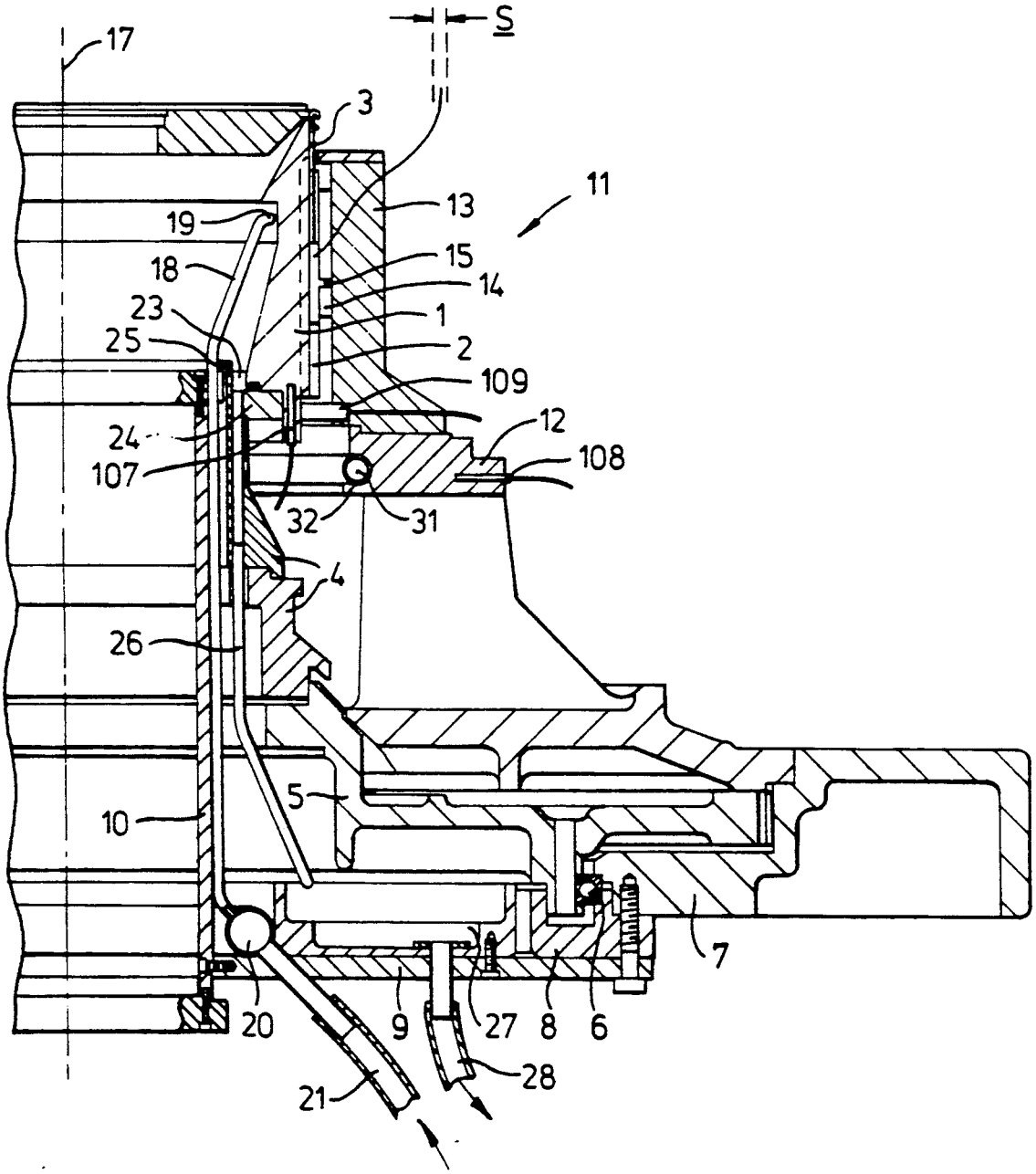
FIG. 1 is a view in vertical section through one half of the part which is essential for the invention, of a circular knitting machine according to the invention.
Figure 2:
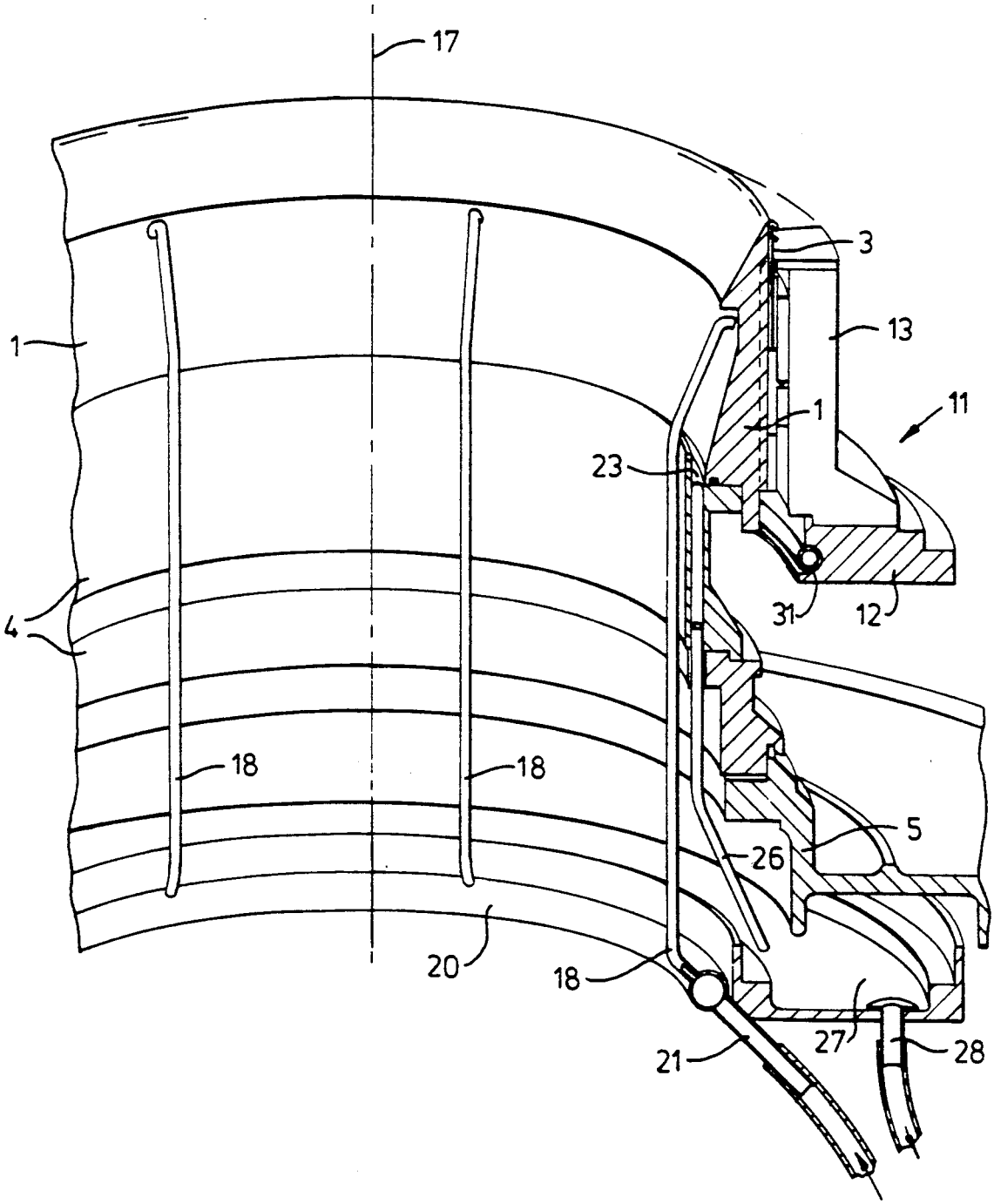
FIGS. 2 and 3 are diagrammatic perspective views on a larger scale than FIG. 1 of parts thereof respectively showing the needle cylinder and the associated cam arrangement of the circular knitting machine of FIG. 1.
Figure 3:
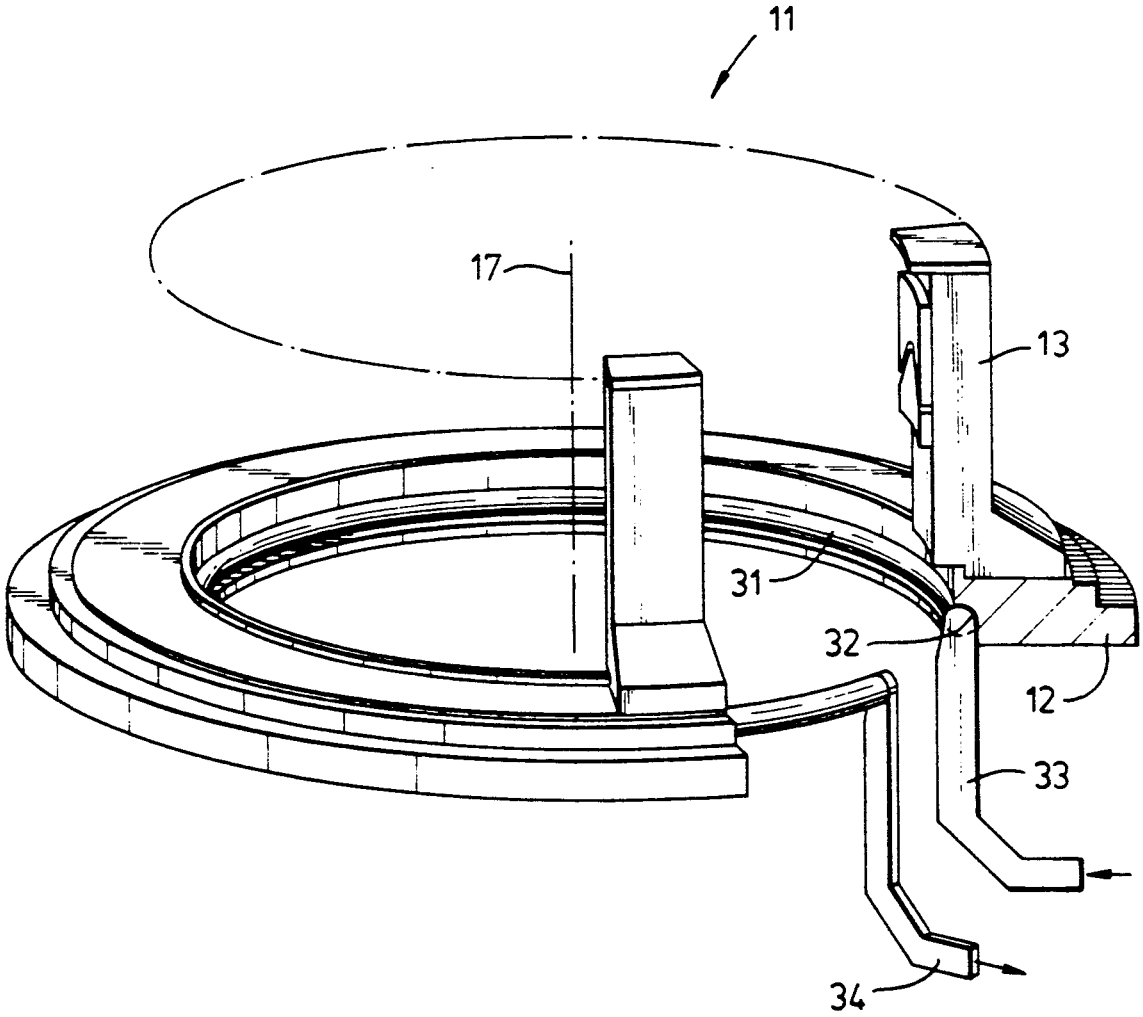

Referring to FIGS. 1 to 3 showing the embodiment which is deemed to be the best solution at the present time, a circular knitting machine includes a carrier 1 in the form of a rotatable needle cylinder with lands 2, between which knitting implements 3, in this case conventional latch needles, are slidably mounted. The carrier 1 is fixed on an intermediate cylinder 4 which is formed from two rings and which in turn is fixed on a cylinder carrier ring 5. The cylinder carrier ring 5 is rotatably mounted by means of bearings 6 on an outer stationary carrier ring 7 of the machine frame structure. Secured to the underside of the carrier ring 7 is a bearing cover 8 and secured to the underside thereof is an annular plate 9 extending about as far as the projection of the inside periphery of the intermediate cylinder 4. Mounted on the inner peripheral edge of the plate 9 is an upwardly projecting cylindrical wall portion 10 which extends upwardly as far as the carrier 1. Instead of the plate 9, it would also be possible for the machine to have individual struts which are arranged in a spoke-like manner and on which individual carriers are mounted, instead of the wall portion 10.

Supported on the carrier ring 7 is a stationary cam arrangement 11 which includes a cam plate 12 on which are fixed a plurality of segments 13 which are arranged in a distributed array at the periphery of the carrier 1 and which carry cam members 14 associated with the carrier 1 and serve in the usual way to control the knitting implements 3 by acting on the butts 15 thereof.

Mounted in the wall portion 10 or the carriers is at least one vertical spray pipe 18, the upper end of which is inclined in the direction of the carrier 1 and has a discharge flow opening 19 which is directed directly on to an upper part of the inner peripheral surface of the carrier 1. Preferably the machine has a plurality of such spray pipes 18 which are arranged in a distributed array around the centre line 17 of the carrier 1. The lower ends of the spray pipes 18 are in flow communication with at least one conduit 20 which is arranged in the space between a collecting trough 27 and the wall portion 10 or the carriers, which extends in an annular configuration around the centre line 17 of the carrier 1, and which has an inlet connection 21.

Arranged at the lower end of the carrier 1 is a further collecting trough 23 which is formed by the carrier 1, an annular shoulder 24 on the intermediate cylinder 4 and a cylindrical closure wall 25 projecting upwardly from the intermediate cylinder 4, and surrounds the centre line 17 of the carrier 1 in an annular configuration. The bottom of the collecting trough 23 communicates with the upper end of a return pipe 26 which passes axially through the intermediate cylinder 4 and the lower end of which terminates in the collecting trough 27 which surrounds the centre line 17 in an annular configuration and which is provided with a discharge connection 28. Alternatively it would also be possible to provide a plurality of return pipes 26. In that connection the sum of the discharge flow cross-section is respectively so selected that the maximum amount of coolant introduced into the collecting trough 23 can be securely drained away.

The parts 18 to 27 are components of a first open circuit of a heat exchange apparatus of the circular knitting machine, which is intended for heat exchange with the carrier 1. In that connection the parts 18 to 21, 27 and 28 are mounted in stationary relationship in the machine frame structure while the parts 23 to 26 perform a rotary movement about the centre line 17 in operation of the circular knitting machine, together with the carrier 1, the intermediate cylinder 4 and the cylinder carrier ring 5.

FIGS. 1 and 3 show the essential parts of a second closed circuit of the heat exchange apparatus, which is intended for heat exchange with the cam arrangement 11. The second circuit includes a conduit 31 which extends in an annular configuration around the centre line 17 and which is arranged in a suitably shaped recess 32 in the cam plate 12. The conduit 31 communicates with inlet and outlet connections 33 and 34 respectively, at respective ones of two ends which are arranged closely one beside the other. The conduit 31 preferably comprises a material which is a good conductor of heat, preferably a metal, and it is in intimate contact over as large a part of its peripheral surface as possible, with the cam plate 12 which consists of steel.

A liquid heat exchange agent, preferably water, is provided for the two described circuits as the heat exchange agent.

The two circuits operate substantially as follows:

The heat exchange agent is supplied to the first open circuit through the inlet connection 21, then passes through the conduit 20 into the spray pipes 18 and leaves same through the discharge flow openings 19 thereof, whereupon it flows down along the inside wall of the rotating carrier 1, is caught in the first collecting trough 23 and then passes by way of the return pipes 26, which also rotate, into the second collecting trough 27 from which it flows away through the discharge connection 28. On the other hand the heat exchange agent flows through the second closed circuit by passing through the inlet connection 33 into the conduit 31 and then leaving the latter again through the discharge connection 34.

The spacing which is radial in FIG. 1 between the outside periphery of the carrier 1 or its lands 2 and the front sides of the cam portions 14, which are towards same, is usually identified as the cam play s which, depending on the design configuration involved, may be of a magnitude of for example 0.25 mm.

Systematic tests on circular knitting machines, in particular large-scale circular knitting machines with high numbers of systems and high speeds of rotation have surprisingly led to the result that malfunctions of widely varying kinds can be caused during on-going operation of the machine by the temperature difference between the carrier 1 and the cam arrangement 11 being intentionally increased or reduced by heating or cooling the heat exchange agents in the two circuits in different ways. That is attributed to the fact that the dimensions or other properties of the components involved in the machine configuration vary greatly due to the influences of temperature and as a result can give rise to malfunctions. The summing of such variations can also result in malfunctions. In accordance with the invention it is concluded therefrom that, for the purposes of preventing such operational disturbances, the important consideration is not straightforward and uncontrolled cooling or preheating of just any components of a circular knitting machine, in particular solely the carrier 1 or solely the cam arrangement 11, but rather the crucial consideration is adjusting the temperature of the carrier 1 and the cam arrangement 11 in a controlled manner so that the temperature difference between the two remains within a tolerance range which is critical for each machine or for each type of machine. Tests have confirmed that the operational disturbances which are frequently observed when not using heat exchange apparatuses or when wrongly using heat exchange apparatuses are markedly less if the temperature difference in all operating conditions of the circular knitting machine is kept within the specified tolerance range. In practice that can be achieved for example in that the temperatures of the carrier 1 and the cam arrangement 11 are continuously monitored by means of temperature sensors and the quantitative flow rates of the heat exchange agent in the two circuits are correspondingly controlled. It would also be possible however to ascertain once the temperature differences which occur in particularly critical operating conditions, for example when operating at the nominal speed of rotation, to correspondingly establish once the quantitative flow rates in the two circuits, and to maintain the flow of the heat exchange agent constant during operation of the circular knitting machine irrespective of whether the circular knitting machine is just operating at the nominal speed of rotation, at another speed of rotation or is temporarily in a stopped condition.

As it is not always a simple matter reliably to ascertain the temperature difference, it is further proposed in accordance with the invention that the maintenance of the admissible temperature difference is monitored by means of the cam play s. Tests have surprisingly shown that it is possible to infer the occurrence of operational disturbances caused by the influences of temperature, from the instantaneous magnitude of the cam play s, with a sufficient degree of certainty. More specifically, in the case of circular knitting machines, an admissibly large (small) cam play s means that the carrier 1 is excessively greatly cooled (heated) relative to the cam arrangement 11 or conversely the cam arrangement 11 is excessively greatly heated (cooled) relative to the carrier 1. Therefore, in place of a tolerance range in respect of the temperature difference, it is possible to lay down a tolerance range in respect of the cam play s for each machine or each type of machine, and the temperature control effect by virtue of the heat exchange agents in the two circuits can be so controlled that the cam play s remains within the tolerance range.

Figure 4:
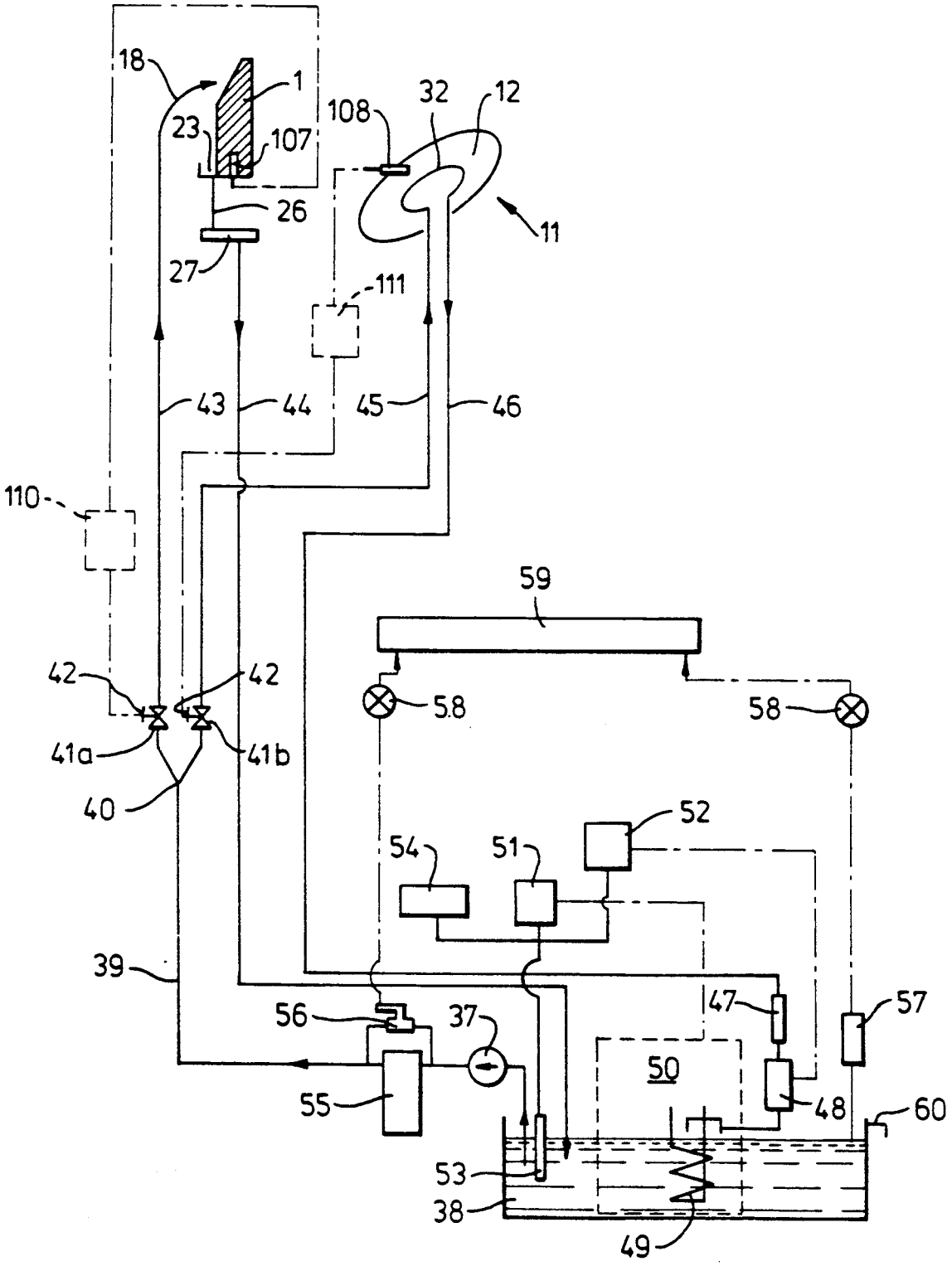
FIG. 4 is a diagrammatic view of an arrangement for operating the circular knitting machine as shown in FIGS. 1 to 3.

FIG. 4 is a highly diagrammatic view of an arrangement by way of example for operating the heat exchange apparatus shown in FIGS. 1 to 3, with the same reference characters being used as far as possible.

The heat exchange agent, in this case water, is urged by means of a pump 37 from a supply container 38 which is disposed for example in a cabinet beside the circular knitting machine, into a flow line 39 which is connected by way of a branch 40 to two devices 41*a* and 41*b* for controlling the quantitative flow rate. The devices 41*a*, 41*b* comprise for example a valve, a spool, an apertured plate or the like, wherein at least one of the two devices 41*a* and 41*b* is provided with adjusting members 42 for the selective and preferably continuous adjustment of the quantitative flow rate. The partial flow of heat exchange agent which flows through the device 41*a* passes by way of a line 43 and the inlet connection 21 (shown in FIG. 1 but not shown in FIG. 4) into the spray pipes 18, trickles down along the inside wall of the carrier 1 in the form of a curtain of water and passes by way of the collecting trough 27 into a return conduit 44 and from there back into the supply container 38, thus providing the first circuit which is open in this construction. On the other hand the partial flow of heat exchange agent which flows through the device 41*b* flows through a line 45, the conduit 32 of the cam plate 12 and then a return conduit 46 from which it flows back into the supply container 38 through a flow monitor device 47 and a heating device 48, thereby completing the second circuit which is closed in this construction. In that connection the last end of the return conduit 46 can be connected to a counter-flow evaporator 49 of a diagrammatically indicated cooling apparatus. The flow monitor device 47 in that arrangement serves to protect the heating cartridge of the heating apparatus 48 from damage in the event of accidental interruptions in the second circuit.

The heated heat exchange agent which flows back through the return conduits 44 and 46 is cooled if necessary to the desired feed temperature in the supply container 38 by the cooling apparatus 50 which operates on the refrigerator principle.

The main purpose of the assembly shown in FIG. 4 is that of dividing up the coolant flow which flows through the flow conduit 39, by means of at least one of the two devices 41*a* and 41*b*, thereby to cool the carrier 1 and the cam arrangement 11, in such a way that the temperature difference thereof is in the desired tolerance range at the nominal speed of rotation. In addition the quantitative flow rates in the conduits 43 and 45 and the heat exchange areas are preferably of such magnitudes that the individual temperatures of the carrier 1 and the cam arrangement 11 are below 50° Celsius, for example between 40° Celsius and 50° Celsius, so that if necessary the circular knitting machine can be repaired or maintained immediately after it has been shut down. The manner of dividing the partial flows of heat exchange agent, which is required in a specific situation, is experimentally ascertained by reference to the respective type of machine and the heating effect which occurs at the nominal speed of rotation thereof, as experience has shown that calculations are highly inaccurate. In contrast the tolerance range to be maintained in respect of the temperature difference is preferably ascertained by a procedure whereby the respective cam play s occurring are measured in a series of measuring operations with different temperature control in respect of the carrier 1 and the cam plate 12, by for example stopping the circular knitting machine, removing a segment 13 (see FIG. 1) and measuring the cam play s at a remaining segment by means of a gauge, in particular a feeler gauge or blade gauge. After the series of measurements have been made, an admissible tolerance range in respect of the cam play s is established and each partial flow of the heat exchange agent is so adjusted by means of the devices 41*a*, 41*b* that the desired temperature patterns are produced when the machine is warmed up.

It will be appreciated that it is also possible with the arrangement shown in FIG. 4 for the carrier 1 and the cam arrangement 11 to be heated up to the operating temperature before the circular knitting machine is switched on in order thereby to avoid the known and undesirable consequences of a cold start. For the purpose it is only necessary for the heating device 48 to be switched on beforehand.

In that connection a substantially constant temperature difference or a substantially constant cam play can be achieved by straightforward control of the heat exchange apparatus, by for example establishing and adjusting a partial flow of heat exchange agent in such a way that the carrier 1 and/or in a corresponding fashion the cam arrangement 11 is kept at the desired temperature, and the other partial flow then being adjusted relative to the first partial flow until the carrier 1 and/or the cam arrangement 11 also assumes substantially the same temperature, or vice-versa.

The heat exchange apparatus shown in FIG. 4 can further be of such a design configuration that the heating device 48 and the cooling device 50 are connected into circuits 51 and 52 of a regulating circuit assembly which keeps the temperature of the heat exchange agent in the supply container 38 constant. For that purpose the temperature measurement values which are measured by a temperature sensor 53 and which can be displayed by a digital display 54 are passed to the circuits 51 and 52. In that way it is possible to keep the temperature difference between the carrier 1 and the cam arrangement 11 constant, with varying conditions, for example outside temperatures, by virtue of the setting of at least one of the devices 41*a* and 41*b* being altered in a defined manner. In addition the circuits 51, 52 and the entire heat exchange apparatus may be so controlled that the water temperature in the supply container 38 or the carrier 1 and the cam arrangement 11 can also be kept at the required operating temperature during prolonged interruptions in operation.

In addition the arrangement shown in FIG. 4 may be provided with a filter 55 which is connected into the flow line 39, a differential pressure sensor 56 which is intended for controlling the filter, a filling state display device 57 for monitoring the level of water in the supply container 38, a fault signalling device 59 which is connected to the display 57 and which has warning lamps 58, and an overflow 60 for the supply container 38.

Figure 5:
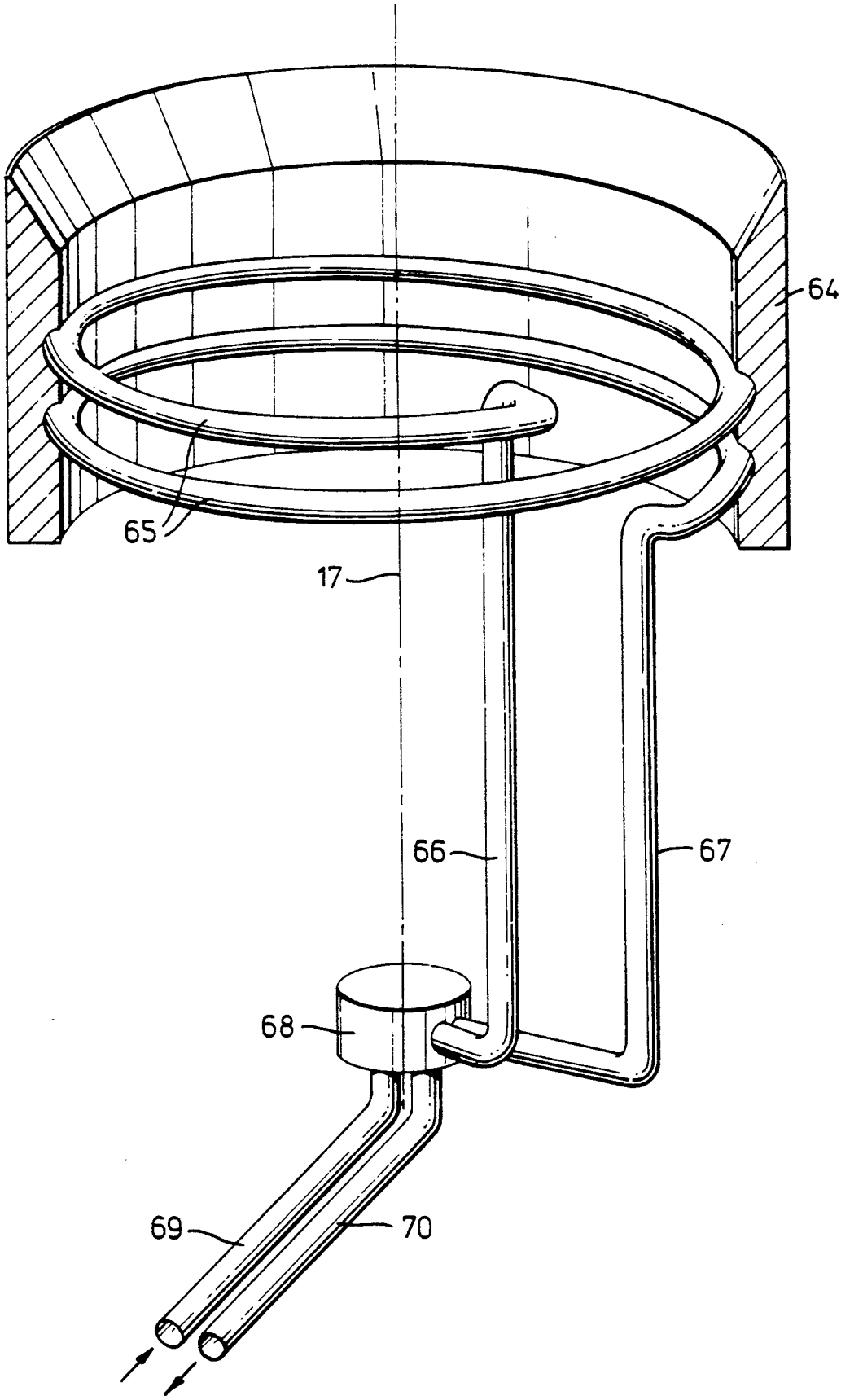
FIG. 5 is a view corresponding to that shown in FIG. 2 of a second embodiment of the needle cylinder of a circular knitting machine according to the invention.

Instead of an open circuit as shown in FIGS. 1 and 2, which at the present time is considered as being the best solution in regard to its level of efficiency, it is also possible to use a closed circuit for a carrier 64 corresponding to the carrier 1 (see FIG. 5). The carrier 64 includes a conduit 65 which is preferably laid at its inside peripheral surface and which is desirably arranged in a plurality of turns in a spiral configuration and which is embedded into a corresponding recess in the carrier 64 in order to provide a heat exchange area of sufficient size. The ends of the conduit 65 are each provided with an inlet and outlet conduit 66 and 67 respectively. As, in a circular knitting machine with a rotatable carrier 64, the inlet and outlet conduits 66 and 67 and the conduit 65 rotate together with the carrier 64, the free ends of the conduits 66 and 67 are connected to the rotatable connections of a rotary connector 68, the stationary feed and discharge conduits 69 and 70 of which are connected for example to the feed and discharge conduits 39 and 44 shown in FIG. 4. Rotary connectors 68 of that kind are generally known to the man skilled in the art as they are already used for example for fuzz blow-off or cooling devices which operate with air (German published specification (DE-AS) No 11 13 786 and German patent specification 3 101 154). At the present time however the most appropriate constructions appear to be rotary connectors as are used for example in lathes, printing machines, in the paper industry or the like, and as are marketed for example by Deublin-Vertriebs-GmbH of D-6238 Hofheim-Wallau (Federal Republic of Germany).

Figure 6:
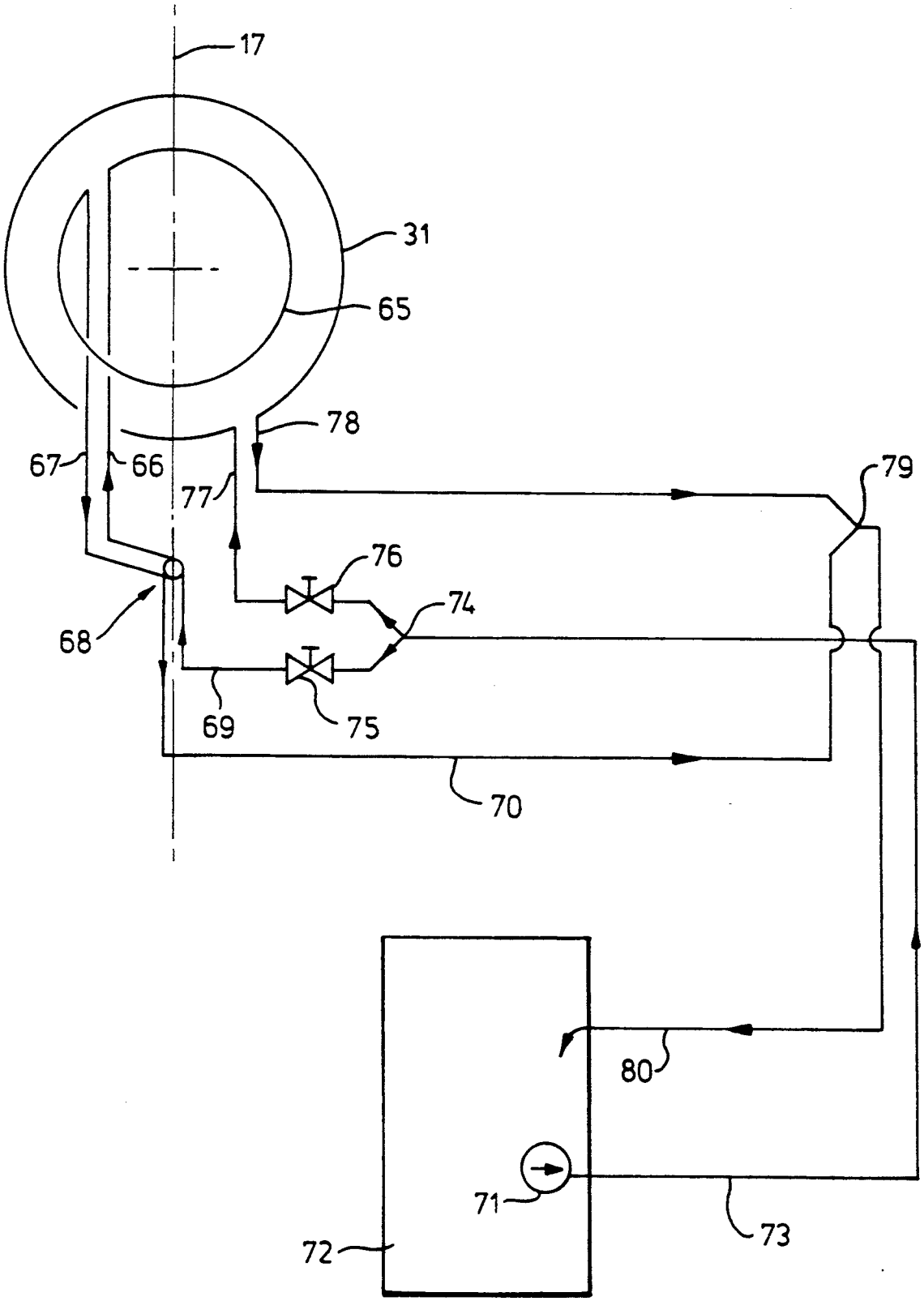
FIG. 6 is a diagrammatic view of an arrangement suitable for operating a circular knitting machine having a cam arrangement as shown in FIG. 3 and a needle cylinder as shown in FIG. 5.

Control of the closed circuit shown in FIG. 5 for the carrier 64 and the also closed circuit shown in FIG. 3 for the cam arrangement 11 may also be effected for example by the arrangement shown in FIG. 6, in which the same components are denoted by the same reference characters. As in FIG. 4, the heat exchange agent, in particular water, is pumped by means of a pump 71 from a supply container 72 into a feed line 73 which is connected by way of a branch 74 to respective devices 75, 76 for adjusting the quantitative flow rate. In that assembly the device 75 is connected to the feed conduit 69 of the rotary connector 68 and the device 76 is connected to the feed line 77 for the conduit 31. The return flow is by way of the return conduit 70 and a further return conduit 78 which is connected to the conduit 31; the conduits 70 and 78 communicate at 79 with a common conduit 80 which goes back to the supply container 72. By adjusting the quantitative flow rates by means of the devices 75 and 76, the overall flow of heat exchange agent can again be distributed on a percentage basis to the conduits 31, 65 in such a way that the desired temperature conditions obtain.

FIGS. 7 to 11 show embodiments for an effective heat exchange between a carrier in the form of a rotatable cylinder for the knitting implements and a liquid heat exchange agent.

Figure 7B:
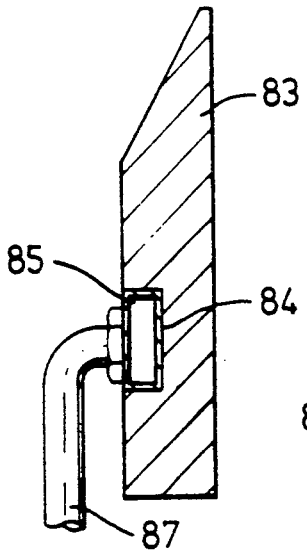
FIGS. 7A to 12B inclusive show embodiments of needle cylinders according to the invention with heat exchange apparatuses.
Figure 7A:
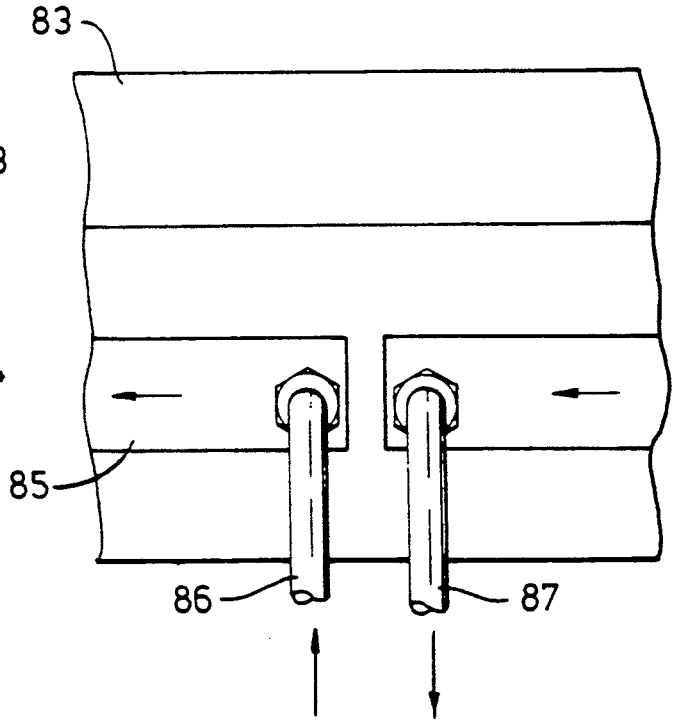

As shown in FIG. 7, machined into the inner peripheral surface of a carrier 83 is a peripherally extending recess 84 of rectangular configuration, into which is embedded a wide flat conduit 85 of corresponding cross-section, the ends of which are disposed closely opposite to each other and are each provided with an inlet connection and an outlet connection 86, 87 respectively.

Figure 8B:
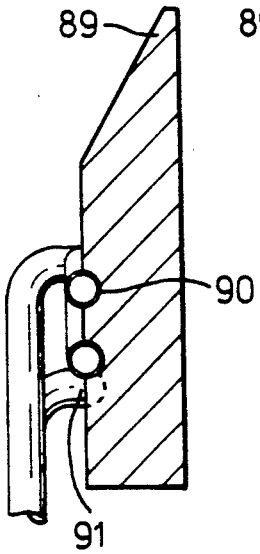
Figure 8A:
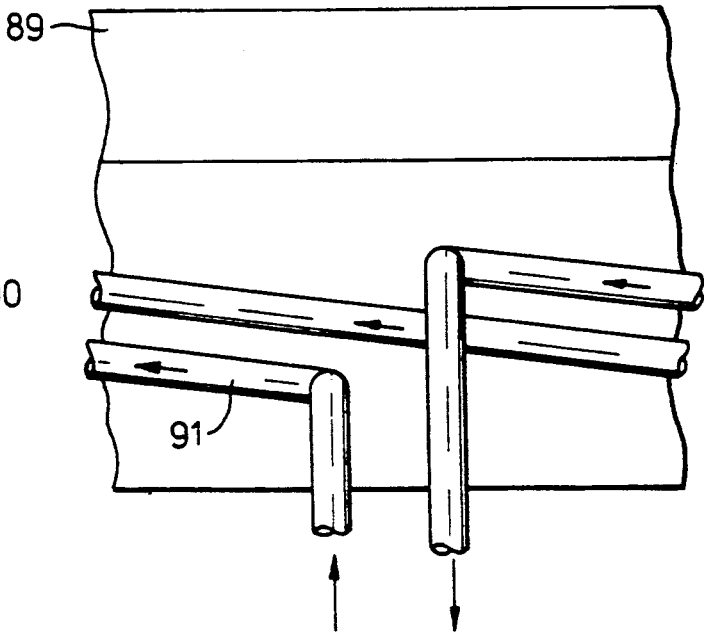

FIG. 8 shows a carrier 89, the inside peripheral surface of which has machined therein a recess 90 of semicircular cross-section which extends in a helical or spiral configuration and which accommodates approximately half of a conduit 91 of a corresponding circular cross-section.

Figure 9B:
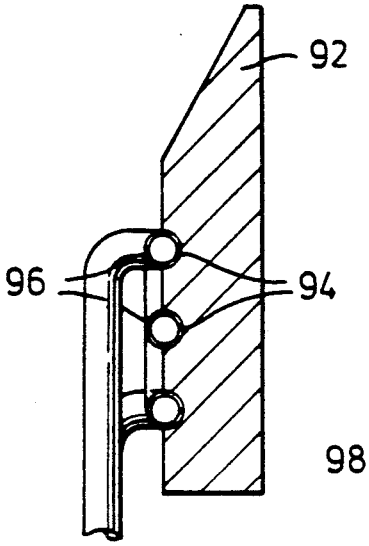
Figure 9A:
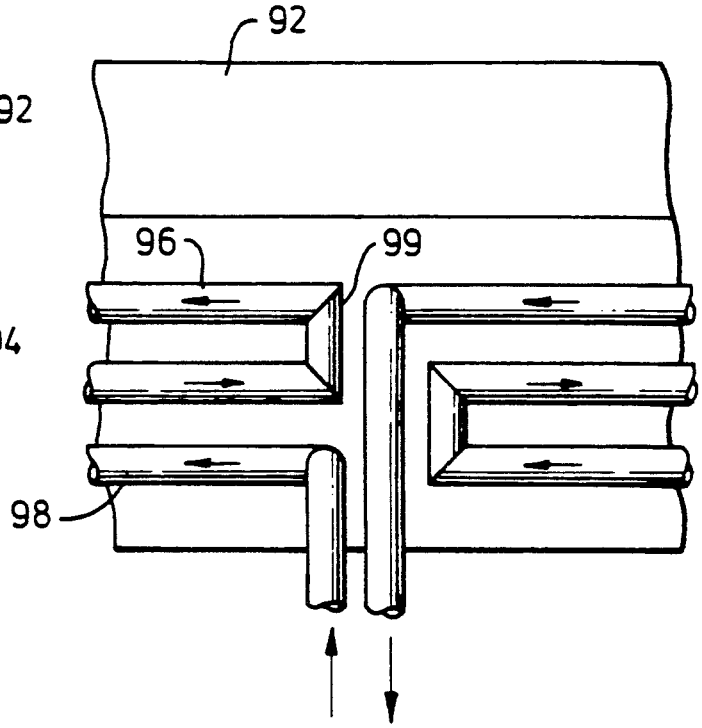
Figure 10B:
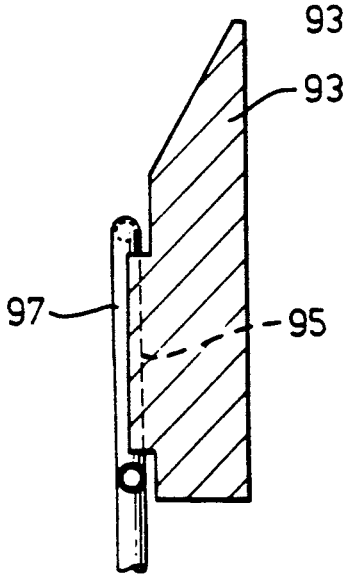
Figure 10A:
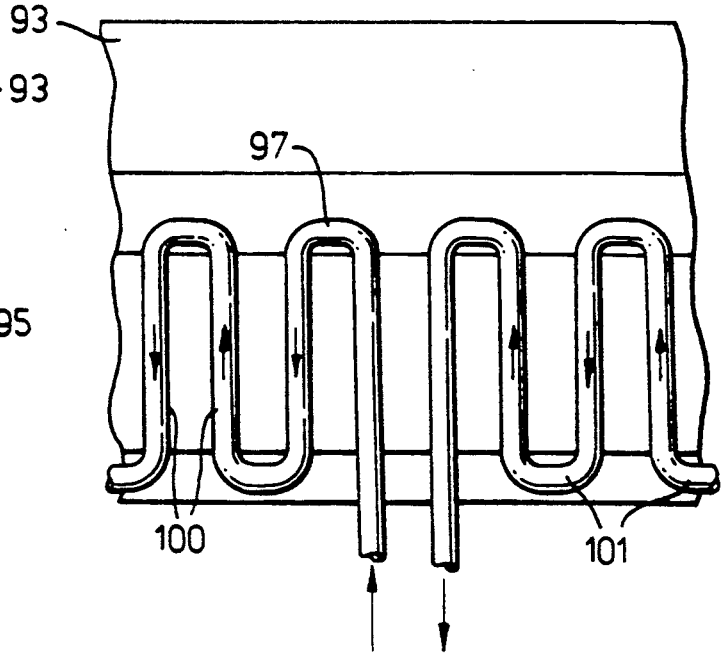

In the embodiments shown in FIGS. 9 and 10 the inner peripheral surface of a carrier 92 and 93 respectively has a recess 94 and 95 respectively of semicircular cross-section in which is arranged one half of a conduit 96 or 97 respectively of corresponding cross-section. The two recesses 94, 95 and conduits 96, 97 extend in a meander configuration. In those arrangements, as shown in FIG. 9, long conduit portions 98 are respectively extended over the length of the periphery and are connected by short conduit portions 99 which extend parallel to the centre line of the carrier 92 (centre line 17 in FIG. 1) while as shown in FIG. 10 long conduit portions 100 which are extended parallel to the centre line of the carrier 93 and over the length of the latter are connected by short conduit portions 101 extending in the peripheral direction. The inlet and outlet connections at the ends of the conduits 91, 96 and 97 as shown in FIGS. 8 to 10 are each identified by arrows.

Figure 11B:
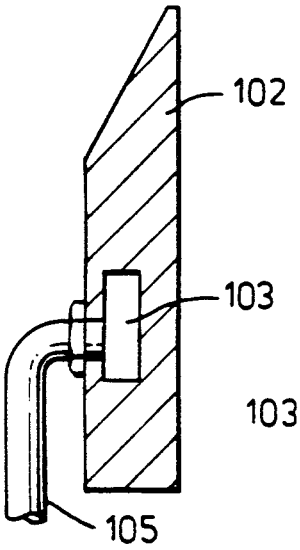
Figure 11A:
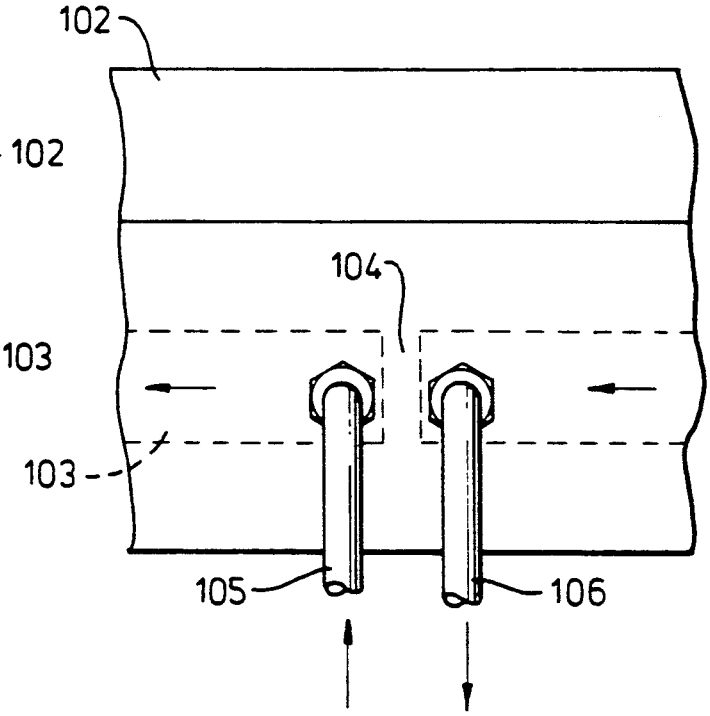

FIG. 11 shows a carrier 102 with an annular cavity 103 which is closed on all sides and which extends in the peripheral direction; the ends of the cavity 103 are disposed in opposite relationship to each other in the region of a narrow intermediate wall 104 and are each connected to a respective outwardly extending inlet and outlet connection 105, 106 respectively.

Figure 12B:
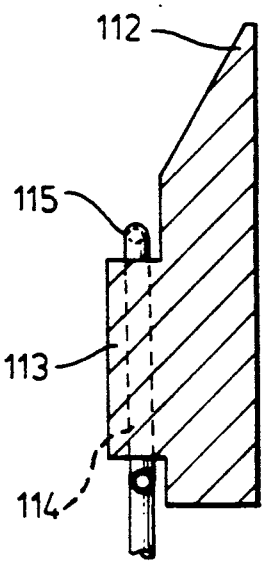
Figure 12A:
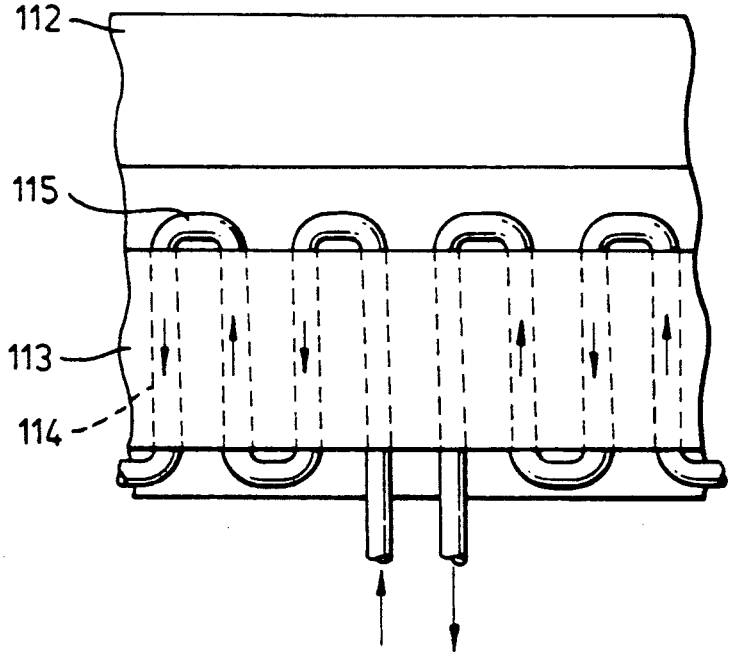

Finally, in an alternative form of the FIG. 10 structure, as shown in FIG. 12, a central portion of the inside peripheral surface of a carrier 112 has an annular projection 113 which is provided with bores 114 which extend parallel to the centre line of the carrier 112 and through which the heat exchange agent can flow directly and which form the long conduit portions. The short conduit portions which extend in the peripheral direction are replaced in this case by connecting conduits 115 connecting the bores 114. Alternatively it would also be possible for additional conduits to be inserted into the bores 114.

All the embodiments shown in FIGS. 5 to 12 provide large contact areas between the carriers and the conduits or the heat exchange medium itself (FIG. 11) and are particularly suitable in combination with a rotary connector 68 as shown in FIGS. 5 and 6 and a cam arrangement 11 as shown in FIGS 1 and 3. The various conduits are desirably again made from a material such as metal which has good heat conductivity. Moreover the embodiment shown in FIG. 8 is particularly preferred because it is the easiest to produce.

The invention is not restricted to the described embodiments but may be modified in many ways. In that connection it will be appreciated that all embodiments can be used both individually and also in the most widely varying combinations. In particular the configurations of the recesses and conduits shown in FIGS. 7 to 12 may also be used in suitably modified form in the cam plate 12 shown in FIG. 3. In addition it is possible for the arrangement shown in FIG. 4 additionally to be provided with temperature sensors 107 and 108 for the carrier 1 and the cam plate 12 (see also FIG. 1) or a distance sensor 109 (FIG. 1) for determining the cam play s. Suitable forms of device for the temperature sensors 107 and 108 are for example the conventional measuring resistors or resistance thermometers as are made and marketed for example by M K Juchheim GmbH & Co of D-6400 Fulda, Federal Republic of Germany, or most appropriately what are referred to as intelligent temperature sensors (see for example 'elektronikpraxis' No 20, Oct. 26, 1989, pages 70 and 114). On the other hand, the distance sensors 109 that may be used are for example ultrasound distance measuring devices ('Der Betriebsleiter' July/August 1984) or most appropriately eddy current travel measuring systems ('industrie-elektrik+elektronik' Nov. 1987, pages 22–24). They could possibly be connected by way of slip rings (not shown) and, as indicated in FIG. 4 by broken lines, by way of circuits 110, 111 of a regulating circuit arrangement, to the adjusting members 42 of the devices 41*a*, 41*b*, in such a way that the temperature difference between the carrier 1 and the cam arrangement 11 or the cam play s automatically assumes a value which is as constant as possible, due to the flow quantities produced in the feed conduits 43 and 45. In that case for example the temperature difference or the cam play s would be the regulating parameter and, as with the control arrangement described with reference to FIG. 4, it would be possible to fixedly set the partial flow in the one circuit and to regulate only the respective other partial flow. Also, such a regulating arrangement could be controlled with time switches or the like in such a way that it remains switched on even when a circular knitting machine is stopped for a prolonged period of time, or it produces the desired temperature conditions again in good time before a circular knitting machine is brought into operation. In a suitable modification the described heat exchange apparatuses can also be used for cooling or heating a carrier in the form of a ribbed plate or a sinker ring or the like or a cam arrangement therefor and in the case of circular knitting machines with stationary carriers (needle cylinders) and rotating cam arrangements.

The most appropriate heat exchange agent is water as it has a thermal capacity which is approximately more than twice as great as oil or the like. That however does not exclude using heat exchange agents other than water and possibly providing higher quantitative flow rates.

In addition the heat exchange output of the two circuits could also be varied with means other than those described, for example by the provision of two completely independent circuits, with the temperatures of the heat exchange agents flowing in those circuits being controlled or regulated.

It would also be possible to provide temperature control in respect of other parts of the cam arrangement 11. However temperature control of just the cam plate 12 has been found to be adequate if both the cam plate 12 and also the segments 13 consist of steel.

Finally it would be possible to combine the described heat exchange apparatus when using a suitable oil with known oil lubricating systems. Preferably however the heat exchange apparatus and the circuits thereof are used solely to provide for temperature control of the carriers and cam arrangements as oil lubricating systems are subject to other requirements which are partly in opposition to those of the described heat exchange apparatuses.

I claim:

1. A circular knitting machine, comprising at least one carrier arranged to displaceably mount knitting implements; a cam arrangement operative for controlling the knitting implements; and a heat exchange apparatus for said carrier and said cam arrangement, said heat exchange apparatus having at least two circuits for a liquid heat exchange agent, one of said circuits being associated with said carrier and the other of said ciruits being associated with said cam arrangement.

2. A circular knitting machine as defined in claim 1, wherein at least one of said circuits has a variable heat exchange output.

3. A circular knitting machine as defined in claim 2, and further comprising a device for controlling a quantitative flow rate of the liquid heat exchange agent, said at least one circuit having a feed conduit connected with said device for controlling said quantitative flow rate.

4. A circular knitting machine as defined in claim 1; and further comprising a common feed conduit connected with both said circuits and having a branch.

5. A circular knitting machine as defined in claim 2, wherein said at least one circuit is controllable so that a temperature difference between the carrier and said cam arrangement remains within a preselected tolerance range under all operating conditions.

6. A circular knitting machine as defined in claim 2, wherein said cam arrangement has cam portions, said at least one circuit being controllable so that a cam play between the carrier and said cam portions remains within a preselected tolerance range under all operating conditions.

7. A circular knitting machine as defined in claim 1; and further comprising a supply container provided for the heat exchange agent and connected with both said circuits; and a regulating circuit associated with said supply container and operative for regulating a temperature of the heat exchange agent in said supply container.

8. A circular knitting machine as defined in claim 1; and further comprising a regulating circuit operative for regulating a heat exchange output in said circuits.

9. A circular knitting machine as defined in claim 8; and further comprising a temperature sensor associated with said regulating circuit and mounted on said carrier and said cam arrangement.

10. A circular knitting machine as defined in claim 8, wherein said cam arrangement has cam portions; and further comprising a distance sensor associated with said regulating circuit and operative for detecting a cam play between said carrier and said cam portions.

11. A circular knitting machine as defined in claim 1, wherein said carrier has an inner peripheral surface, said circuits including a first circuit associated with said carrier and provided with at least one spray pipe directed onto said inner peripheral surface of said carrier.

12. A circular knitting machine as defined in claim 1, wherein said carrier has an inner peripheral surface, said circuits having a first circuit associated with said carrier and having at least one conduit mounted on said inner peripheral surface of said carrier.

13. A circular knitting machine as defined in claim 1, wherein said circuits have a first circuit associated with said carrier and including at least one conduit which is formed as a cavity provided in said carrier.

14. A circular knitting machine as defined in claim 1, wherein said cam arrangement has a cam plate with an inward side, said circuits including a second circuit associated with said cam arrangement and having a conduit arranged on said inward side of said cam plate.

15. A circular knitting machine as defined in claims 1 or 12, wherein said cam plate has an inner peripheral surface provided with a recess, said conduit being arranged in said recess of said inner peripheral surface of said cam plate.

16. A circular knitting machine as defined in claims 12 or 14, wherein said at least one conduit has a helical configuration.

17. A circular knitting machine as defined in claims 12 or 14, wherein said at least one conduit has a spiral configuration.

18. A circular knitting machine as defined in claims 12 or 14, wherein said at least one conduit has a meander configuration.

19. A method of providing uniform temperature conditions on a circular knitting machine having a carrier for knitting implements and a cam arrangement for controlling the knitting implements, the method comprising the steps of adjusting the carrier and the cam arrangement with respect to temperature in a controlled manner with circuits individually associated with the carrier and the cam arrangement, and with liquid heat exchange agents flowing through the circuits; and controlling a heat exchange output of at least one of the circuits so that a preselected substantially constant temperature difference is set between the carrier and the cam arrangement in all operating conditions of the circular knitting machine.

20. A method as defined in claim 19; and further comprising the step of maintaining a cam play within a preselected tolerance range.

21. A method as defined in claim 20; and further comprising the step of using water as the heat exchange agent.

* * * * *